US010385773B2

(12) United States Patent
Huang

(10) Patent No.: US 10,385,773 B2
(45) Date of Patent: Aug. 20, 2019

(54) METHOD OF REMOVING CARBONS FROM VEHICLE ENGINE

(71) Applicant: Ren-Hua Huang, Hunan (CN)

(72) Inventor: Ren-Hua Huang, Hunan (CN)

(73) Assignee: KINGKAR ECO-TECHNOLOGIES CO., LTD., Changsha, Hunan (CN)

( * ) Notice: Subject to any disclaimer, the term of this patent is extended or adjusted under 35 U.S.C. 154(b) by 0 days.

(21) Appl. No.: 15/624,737

(22) Filed: Jun. 16, 2017

(65) Prior Publication Data

US 2018/0363549 A1 Dec. 20, 2018

(51) Int. Cl.
*F02B 77/04* (2006.01)

(52) U.S. Cl.
CPC ..... *F02B 77/04* (2013.01)

(58) Field of Classification Search
CPC ..... F02B 77/04; F02B 2077/045
See application file for complete search history.

(56) References Cited

U.S. PATENT DOCUMENTS 9,771,859 B2 * 9/2017 Haring ..... F02B 43/10
2011/0117361 A1 * 5/2011 Hamilton ..... B82Y 30/00 428/333
2011/0220039 A1 * 9/2011 Nowicki ..... C25B 9/06 123/3
2012/0247522 A1 * 10/2012 Lin ..... F02B 43/10 134/56 R

FOREIGN PATENT DOCUMENTS

CN 101929385 A * 12/2010
CN 103122795 A * 3/2013

* cited by examiner

*Primary Examiner* — Kevin A Lathers
(74) *Attorney, Agent, or Firm* — Justin Lampel

(57) ABSTRACT

A method of removing carbons from a vehicle engine is applied for a carbon removal system of the vehicle engine, and the vehicle engine contains: an atomizer, an oxy-hydrogen carbon cleaning apparatus, an additive storage container, a check valve, an electric-control stop valve, and a flow adjustment valve. The atomizer is in connection with the vehicle engine, the oxy-hydrogen carbon cleaning apparatus is coupled with the atomizer, the additive storage container is joined with the check valve, the additive storage container includes a level gauge accommodated therein, the check valve is connected with the electric control stop valve, the electric control stop valve is coupled with the flow adjustment valve, and the flow adjustment valve is in connection with the atomizer. Accordingly, the additive is added into the oxy-hydrogen carbon cleaning apparatus so as to remove the carbons from the vehicle engine effectively and quickly.

2 Claims, 1 Drawing Sheet

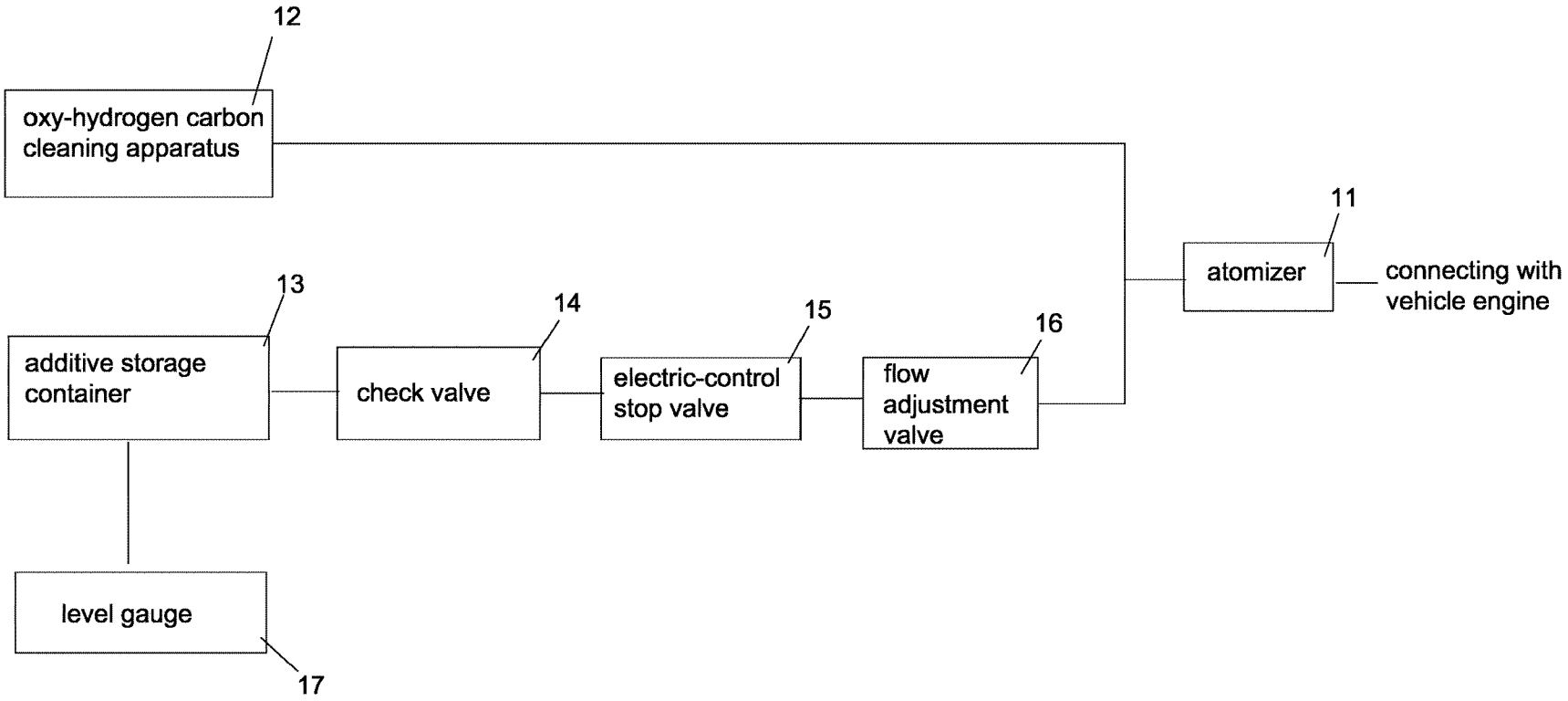
connecting with vehicle engine
11
atomizer
16
flow adjustment valve
15
electric-control stop valve
14
check valve
12
oxy-hydrogen carbon cleaning apparatus
13
additive storage container
17
level gauge

METHOD OF REMOVING CARBONS FROM VEHICLE ENGINE

FIELD OF THE INVENTION

The present invention relates to a method of removing carbons from a vehicle engine.

BACKGROUND OF THE INVENTION

After using a vehicle engine for a period of time, carbon deposits and oily sludge gather in an intake valve, an exhaust valve, an air conduit, a combustion chamber, and an injector nozzle, hence the vehicle is started difficultly, a power of the vehicle engine reduces, oil consumption increases, and a tail gas of the vehicle engine exhausts poorly, thus lowering service lives of the vehicle engine, a spark plug, an oxygen sensor, and an on-board diagnostics (OBD) system.

Carbon removal devices of the vehicle engine are a bottle carbon remover and a foam carbon remover in which chemical reagents are accommodated so as to dissolve the carbon deposits. However, the chemical reagents are corrosive to reduce service life of the vehicle engine, and the carbon deposits block the on-board diagnostics (OBD) system.

To overcome above-mentioned problems, an oxy-hydrogen carbon cleaning apparatus contains an oxy-hydrogen generator configured to produce hydrogen and oxygen, and the hydrogen and the oxygen are drawn into the vehicle engine via an intake tube and mix with fuel in the vehicle engine. The hydrogen deoxygenizes, the oxygen burns the fuel, and the hydrogen oxygen gas burns and produces high-temperature steams for wetting and dissolving the carbon deposits, wherein the hydrogen dissolves and generates hydrogen ions in a high temperature so as to soften the carbon deposits and to revert into inflammable carbon-based substances. Thereafter, the oxygen flames the inflammable carbon-based substances by way of oxygen. As starting the vehicle engine, a thickness of carbon deposits is measured by a Nano unit, and the carbon deposits exhaust as Nano particles or carbon dioxide gas. However, the oxy-hydrogen carbon cleaning apparatus has defects as follows:

A. The carbon deposits are removed for a long period of time, i.e., over one hour.

B. The carbon deposits are eliminated poorly.

The present invention has arisen to mitigate and/or obviate the afore-described disadvantages.

SUMMARY OF THE INVENTION

The primary objective of the present invention is to provide a method of removing carbons from a vehicle engine which obtains sterilization, formaldehyde removal, easy combustion, and oxidation Further objective of the present invention is to provide a method of removing carbons from a vehicle engine which reduces harmful gases.

Another objective of the present invention is to provide a method of removing carbons from a vehicle engine which adds additive into the oxy-hydrogen carbon cleaning apparatus so as to remove the carbons from the vehicle engine effectively and quickly.

To obtain above-mentioned objectives, a method of removing carbons from a vehicle engine provided by the present invention is applied for a carbon removal system of the vehicle engine, and the vehicle engine contains: an atomizer, an oxy-hydrogen carbon cleaning apparatus, an additive storage container, a check valve, an electric-control stop valve, and a flow adjustment valve.

The atomizer is in connection with the vehicle engine, the oxy-hydrogen carbon cleaning apparatus is coupled with the atomizer, the additive storage container is joined with the check valve, the additive storage container includes a level gauge accommodated therein, the check valve is connected with the electric control stop valve, the electric control stop valve is coupled with the flow adjustment valve, and the flow adjustment valve is in connection with the atomizer.

The method of removing the carbons from the vehicle engine contains steps of:

1). detecting a quantity of additive in the storage container by way of the level gauge, determining whether turning on the oxy-hydrogen carbon cleaning apparatus based on the quantity of the additive;

2). starting the electric control stop valve while producing hydrogen oxygen gas after turning on the oxy-hydrogen carbon cleaning apparatus so that the additive flows through the check valve, the electric control stop valve, and the flow adjustment valve to mix with the hydrogen oxygen gas; and 3). mixing the additive and the hydrogen oxygen gas evenly by using the atomizer so as to produce Nano atomized particles, hence the Nano atomized particles flow into an intake manifold of the vehicle engine and remove carbon deposits and oily sludge from various sensors, an intake valve, an exhaust valve, a combustion chamber, a spark plug, an injector nozzle, a piston crown, a piston ring, a catalytic converter, and an on-board diagnostics (OBD) system.

BRIEF DESCRIPTION OF THE DRAWINGS

FIG. 1 is a flow chart of a method of removing carbons from a vehicle engine according to a preferred embodiment of the present invention.

DETAILED DESCRIPTION OF THE PREFERRED EMBODIMENTS

With reference to FIG. 1, a method of removing carbons from a vehicle engine according to a preferred embodiment of the present invention is applied for a carbon removal system of the vehicle engine, and the carbon removal system includes an atomizer 11, an oxy-hydrogen carbon cleaning apparatus 12, an additive storage container 13, a check valve 14, an electric-control stop valve 15, and a flow adjustment valve 16. The atomizer 11 is in connection with the vehicle engine and is configured to mix an additive, hydrogen, and oxygen evenly and to produce Nano atomized particles. The oxy-hydrogen carbon cleaning apparatus 12 is coupled with the atomizer 11 and is configured to produce hydrogen oxygen gas. The additive storage container 13 is joined with the check valve 14 and is employed to store the additive for reducing carbon removal time. The additive and the hydrogen oxygen gas are mixed and atomized so as to be fed into the vehicle engine, wherein the additive resolves carbon depositions and oily sludge at high efficiency (i.e., a removal efficiency of the additive to the carbon depositions and sludge increases 30%). The additive storage container 13 includes a level gauge 17 accommodated therein so as to detect a quantity of the additive, hence the oxy-hydrogen carbon cleaning apparatus 12 operates after feeding the additive. In case the additive runs out, the oxy-hydrogen carbon cleaning apparatus 12 cannot operate. The check valve 14 is connected with the electric control stop valve 15 and is used to avoid the hydrogen oxygen gas flowing back to the additive storage container 13. The electric control stop valve 15 is coupled with the flow adjustment valve 16, wherein when removing the carbons from the vehicle engine, the electric control stop valve 15 starts, and when the carbons are not removed from the vehicle engine, the electric control stop valve 15 stops operation so as to avoid the additive flowing into the oxy-hydrogen carbon cleaning apparatus 12. The flow adjustment valve 16 is in connection with the atomizer 11 so as to adjust a mixing ratio of the hydrogen oxygen gas and the additive, thus obtaining different carbon removals.

A method of removing the carbons from the vehicle engine comprises steps of:

1). detecting the quantity of the additive in the storage container 13 by way of the level gauge 17, determining whether turning on the oxy-hydrogen carbon cleaning apparatus 12 based on the quantity of the additive, wherein the additive is Nano carbon removing fluid or other carbon removing substances;

2). starting the electric control stop valve 15 while producing the hydrogen oxygen gas after turning on the oxy-hydrogen carbon cleaning apparatus 12 so that the additive flows through the check valve 14, the electric control stop valve 15, and the flow adjustment valve 16 to mix with the hydrogen oxygen gas; and 3). mixing the additive and the hydrogen oxygen gas evenly by using the atomizer 11 so as to produce the Nano atomized particles, hence the Nano atomized particles flow into an intake manifold of the vehicle engine and remove the carbon deposits and the oily sludge from various sensors, an intake valve, an exhaust valve, a combustion chamber, a spark plug, an injector nozzle, a piston crown, a piston ring, a catalytic converter, and an on-board diagnostics (OBD) system, thus obtaining sterilization, formaldehyde removal, easy combustion, oxidation, and reducing harmful gases.

Accordingly, the additive is added into the oxy-hydrogen carbon cleaning apparatus so as to remove the carbons from the vehicle engine effectively and quickly.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A system for removing carbons from a vehicle engine, the system comprising:

an atomizer, a means for cleaning carbon with oxy-hydrogen, an additive storage container, a check valve, an electric control stop valve, and a flow adjustment valve;

wherein the atomizer is connected with a vehicle engine wherein the additive storage container is connected to the check valve and wherein the additive storage container has a level gauge;

wherein the check valve is connected with the electric control stop valve and wherein the electric control stop valve is connected with the flow adjustment valve and wherein the flow adjustment valve is connected to the atomizer;

detecting a quantity of an additive in the additive storage container through the level gauge;

activating the electric control stop if the quantity of the additive is above a predetermined level in the additive storage container;

producing a hydrogen oxygen gas wherein the hydrogen oxygen gas first flows through the check valve and then to the electric control stop valve, and then to the flow adjustment valve; and wherein the hydrogen oxygen gas then mixes evenly by using the atomizer so as to produce a plurality of nano atomized particles wherein the plurality of nano atomized particles then flow into an intake manifold of the vehicle engine and wherein the nano atomized particles remove carbon deposits and oily sludge from the vehicle engine.

2. The system for removing carbons from a vehicle engine of claim 1 wherein the additive is nano carbon removing fluid.

* * * * *